United States Patent [19]

Tarver

[11] Patent Number: 4,648,997

[45] Date of Patent: Mar. 10, 1987

[54] AIR INJECTOR

[76] Inventor: Stephen C. Tarver, P.O. Box 127, Gillette, Wyo. 82716

[21] Appl. No.: 822,630

[22] Filed: Jan. 27, 1986

Related U.S. Application Data

[63] Continuation-in-part of Ser. No. 712,970, Mar. 18, 1985, abandoned.

[51] Int. Cl.[4] ..... B01F 3/04

[52] U.S. Cl. ..... 261/25; 261/82; 261/DIG. 74; 261/64.4

[58] Field of Search ..... 261/25, 82, 64 C

[56] References Cited

U.S. PATENT DOCUMENTS

| | | | |
|---|---|---|---|
| 980,447 | 1/1911 | Smith | 261/25 |
| 2,604,310 | 7/1952 | Brown | 261/82 |
| 3,080,154 | 3/1963 | Tanner | 261/82 |
| 3,109,873 | 11/1963 | Hotchkiss | 261/82 |
| 3,756,576 | 9/1973 | Tremolada . | |

FOREIGN PATENT DOCUMENTS

| | | | |
|---|---|---|---|
| 20478 | of 1894 | United Kingdom | 261/82 |
| 19207 | of 1909 | United Kingdom | 261/82 |

*Primary Examiner*—Tim Miles

[57] ABSTRACT

This is a device for injecting air into a water supply under pressure in a closed system. It consists of two sliding pistons inside a closed housing. The two pistons are connected to each other by a connecting rod. They are positioned so that they slide alternately toward one end of the housing and then toward the other end. They are propelled in one direction by water pressure entering the housing through an opening from an outside source. They are propelled in the opposite direction by a coil spring. This device can employ any one of several different means to increase and decrease the water pressure on one piston thereby alternately causing the coil spring to be compressed and then allowed to expand. This causes the second piston to draw air into the housing through a check valve when the coil spring is being depressed and then allows the air to pass through a check into the path of the flowing water when the coil spring is expanding.

1 Claim, 4 Drawing Figures

AIR INJECTOR

CROSS-REFERENCE TO RELATED APPLICATIONS

This application is a continuation-in-part of application, Ser. No. 712,970 filed 3-18-85, Art Unit 135, now abandoned.

BRIEF SUMMARY OF THE INVENTION

One way to remove iron and rust from water for household use is to inject air into the water supply under pressure as it comes from the source and then run the water through a screen to break the air bubbles into a multitude of microscopic bubbles. The oxygen in these bubbles combines with the iron in the water turning it into tiny particles of rust which can then be easily filtered out of the water by running it through a filter tank containing appropriate filtering material.

The present invention, when installed in the incoming water line, provides a simple and effective method of injecting the air into the water to provide the necessary oxygen for the above-described iron removal process.

Figure 1:
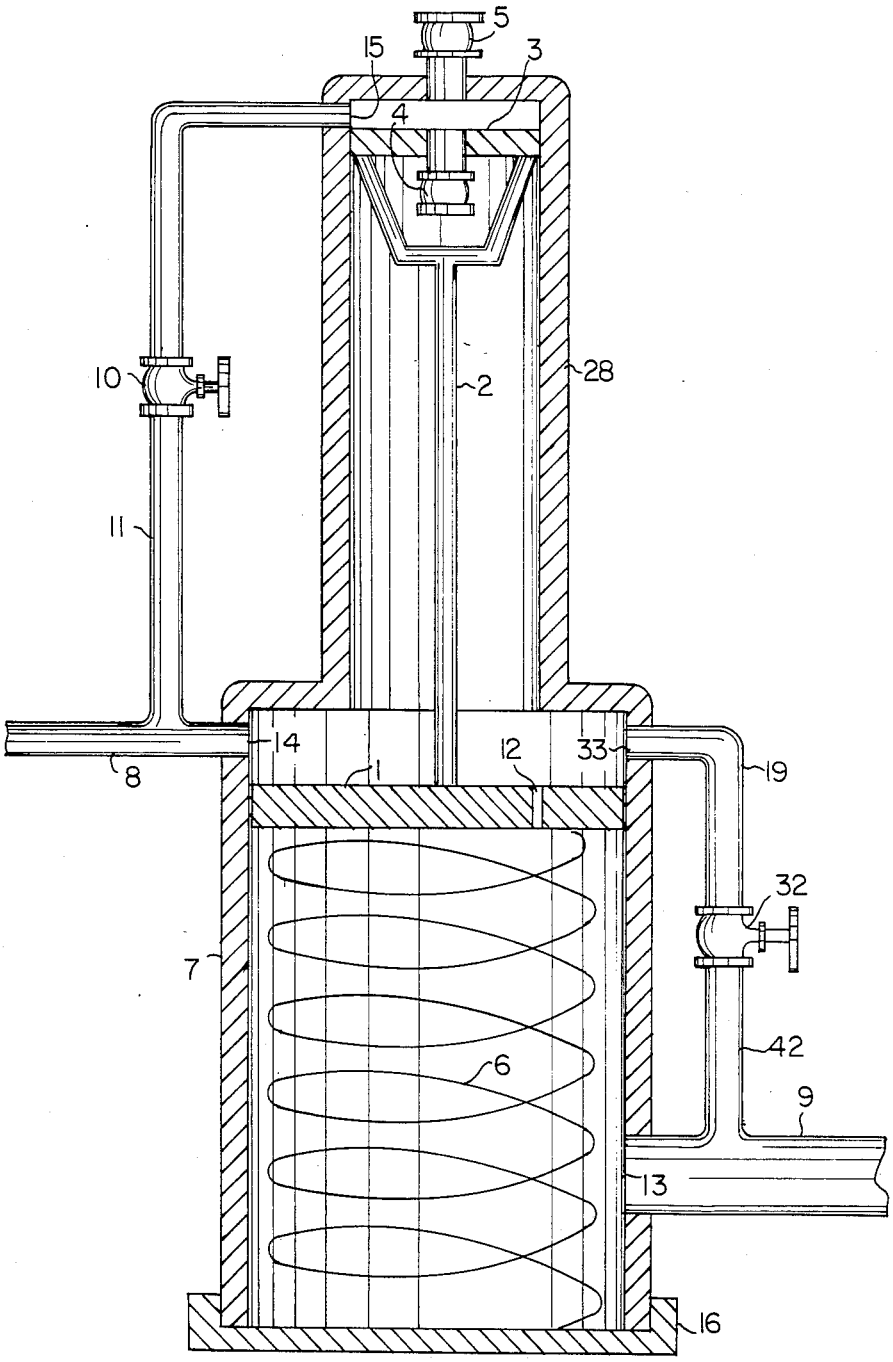
FIG. 1 shows a dual-piston device capable of injecting air into a pressurized water supply. Each of FIGS. 2–4 show modifications of the FIG. 1 device.

As shown in the accompanying drawing FIG. 1, it consists of a closed chamber, preferably cylinderical in shape, with one end section 7 substantially larger than the other end section 28.

When water under pressure from pipe 8 goes through opening 14, chambers 7 and 28 fill with water, assuming the outlet valves connected to pipe 9 are all closed. The portion of chamber 7 below piston 1 is filled by water running through bleed hole 12. When chambers 7 and 28 are full, the water will be under pressure equal to that exerted from the source through inlet pipe 8.

When an outlet valve to which pipe 9 is connected is opened, the pressure, referred to above below piston 1 is released. This results in the remaining pressure above exerting sufficient force on piston 1 to drive it past opening 13 so that water can continue to flow through pipe 9 as long as an outlet valve connected to pipe 9 remains open.

When piston 1 moves to allow this passage of water, it pulls piston 3 through connecting rod 2 away from the end of chamber 28, thereby creating a vacuum in that end of chamber 28. Check valve 5 then opens inwardly allowing that vacuum to fill with air to atmospheric pressure.

When piston 1 moves toward opening 13 as described above, it compresses coil spring 6 putting an upward pressure on piston 1.

As soon as the outlet valve is closed and water stops flowing, coil spring 6, putting that upward pressure on piston 1, pushes it back toward its original position. Water flowing through bleed hole 12 makes it possible for the water on the upper side of piston 1 to flow through to the bottom side of piston 1 making it possible for piston 1 to rise.

When piston 1 is pushed back to its origional position, piston 3 is also pushed back to the end of cylindrical section 28. Check valve 5 closes to trap the air which was drawn in on the first stroke of piston 3. On the return stroke check valve 4 in piston 3 opens toward piston 1 to allow the air trapped in the end of chamber 28 to escape toward piston 1 into the lower part of chamber 28.

The next time an outlet valve to which pipe 9 is connected is opened, causing piston 1 to move toward opening 13, check valve 4 closes and piston 3 pulls this air into the path of the water flowing from opening 14, thus completing the desired air injection process.

While the pressure per square inch would exert a force on piston 3 as it would on piston 1, when the pressure is released through pipe 9, the much larger surface area of piston 1 would result in a much larger total force being exerted on piston 1 than on piston 3, resulting in the movement toward opening 13.

To facilitate the prevention of an excessive amount of air from being injected into the water supply, valve 10, which would normally be closed, can be opened slightly to allow a small amount of water to flow through pipe 11 to the space between piston 3 and the end of chamber 28. This would reduce the vacuum and hence the amount of air drawn through check valve 5 when piston 3 is pulled away from the end by the movement of piston 1.

Figure 2:
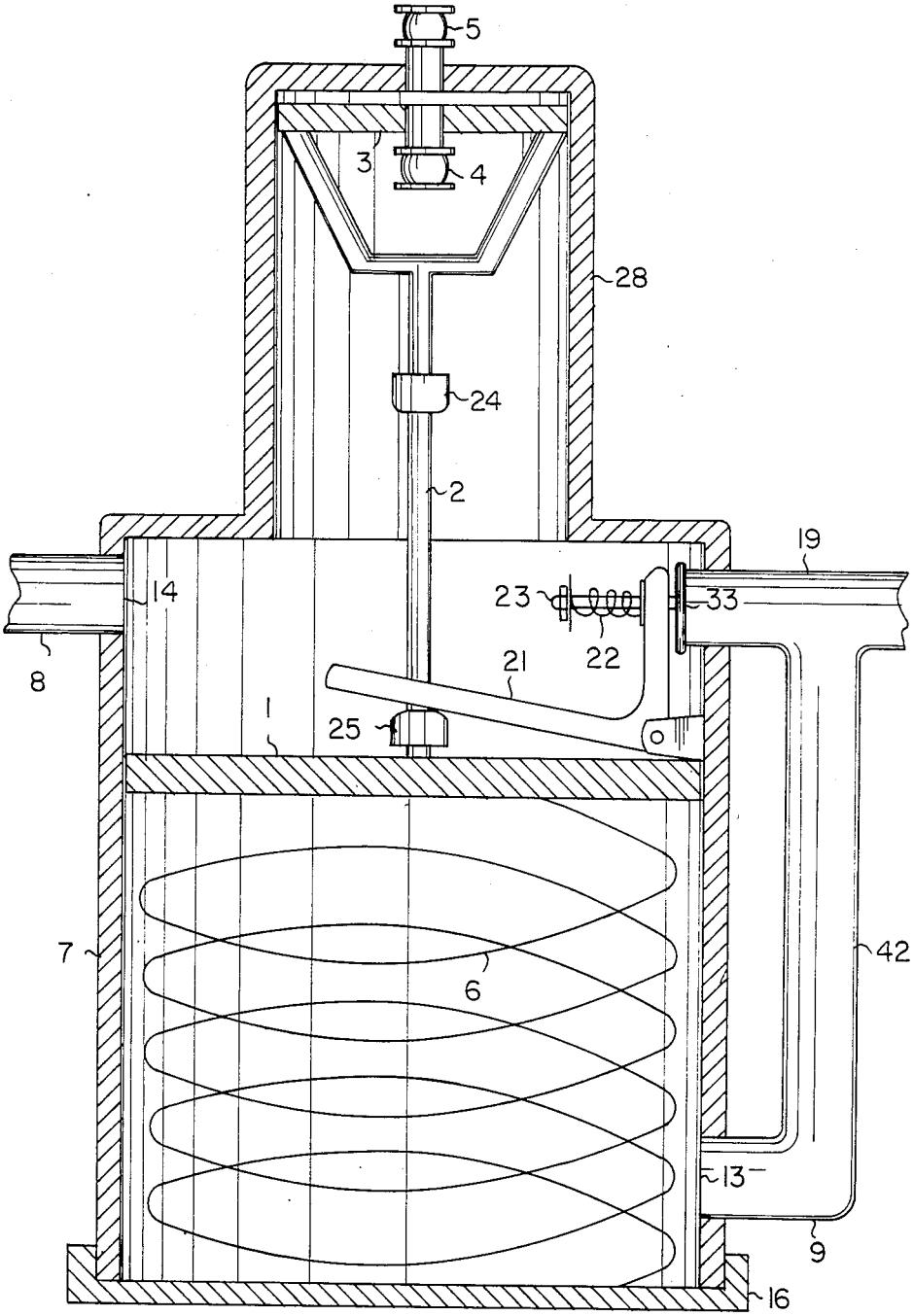

Since the air injector, just described, injects air only when water begins running through it, a problem could arise if the water continues running for a considerable length of time. The continuously running water would wash all of the oxygen out of the system since piston 1 and piston 3 would not be moving as long as water continues to run. Consequently piston 3 would not be drawing in enough air to keep an ample supply of oxygen in the water to oxidize the iron. In order to provide a remedy if this problem should arise, the modification illustrated in FIG. 2 could be utilized. This would assure an ample supply of air being injected into the water even if the water ran a long time without stopping.

This modification consists of adding a bypass pipe 42 and outlet pipe 19 to run water from the upper end of section 7 of the housing through opening 33 to opening 13 through pipe 42 as well as away from the air injector through pipe 19.

This would occur when piston 1 would, moving toward opening 13, pull disc valve 23 away from opening 33 through slotted lever 21 when it is engaged by shoulder 24. When this occured the pressure on the upper side of piston 1 would be reduced enough through this flow of water to allow coil spring 6 to push piston 1 back to its origional position. Until piston 1 returned to its starting position, disc valve 23 would be held open by spring 22 and the weight of the slotted lever 21.

When piston 1 returns to its starting position, shoulder 25 would engage slotted lever 21 thereby causing disc valve 23 to close. This would result in an increase in pressure again on the upper side of piston 1, resulting in its movement again toward opening 13. This would result in piston 3 drawing in more air.

This alternating flow of water, first through opening 13 and pipe 9 and pipe 42 and then through opening 33 would result in a continuous flow of water from pipe 19 and a repeated injection of air.

By adding bypass pipe 42 and adjustable valve 32 to the basic air injector as illustrated in FIG. 1, it would be feasible to eliminate bleed hole 12 in piston 1. This would have the advantage of avoiding the possibility of bleed hole 12 becoming plugged with sediment.

Figure 3:
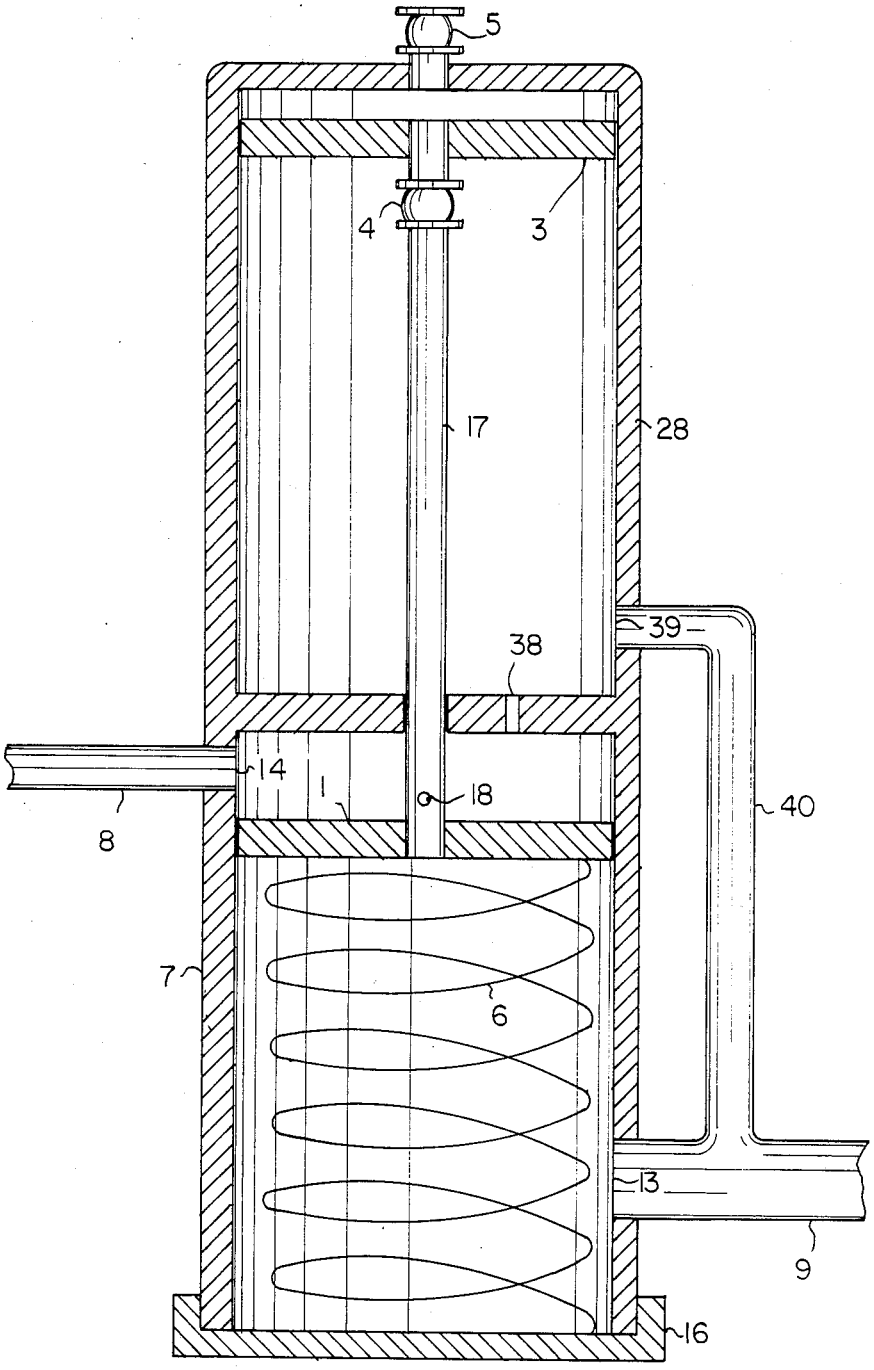

Another embodiment of this invention is illustrated in FIG. 3. This embodiment employs a dividing wall between the end sections with an opening in it for the connecting rod to pass through. This would make it possible to have both end sections the same diameter since the pressure of the incoming water would not be applied directly to piston 3 causing a force in the opposite direction of that on piston 1 as is the case in the embodiment illustrated in FIG. 1 and FIG. 2.

Essentially this embodiment would function in the same way as that shown in FIG. 1 except that instead of the air necessarily being mixed with water inside of the housing, it could be mixed with the water in pipe 9 as it flows from the injector. In this embodiment bleed hole 38 in the dividing wall would permit water to flow from the upper side of piston 1 into chamber 28 and then through opening 39 and opening 13 to the lower side of piston 1 thus allowing piston 1 to return to its starting positon when water stops running from the injector through pipe 9. This assumes that the connecting rod would be of the type shown in FIG. 1.

The embodiment illustrated in FIG. 3 with a hollow connecting rod 17 and bleed hole 18 would result in the air and water being mixed in chamber 7 below piston 1. When water stopped running from the injector through pipe 9, water pressure below piston 1 and in chamber 28 would be equalized by water flowing through bleed hole 18. This would make it possible for coil spring 6 to return piston 1 to its starting position allowing the air above piston 3 to pass through check valve 4 and through hollow connecting rod 17 to the lower side of piston 1 where it would mix with the water and eventually leave the injector through pipe 9 along with the water.

Figure 4:
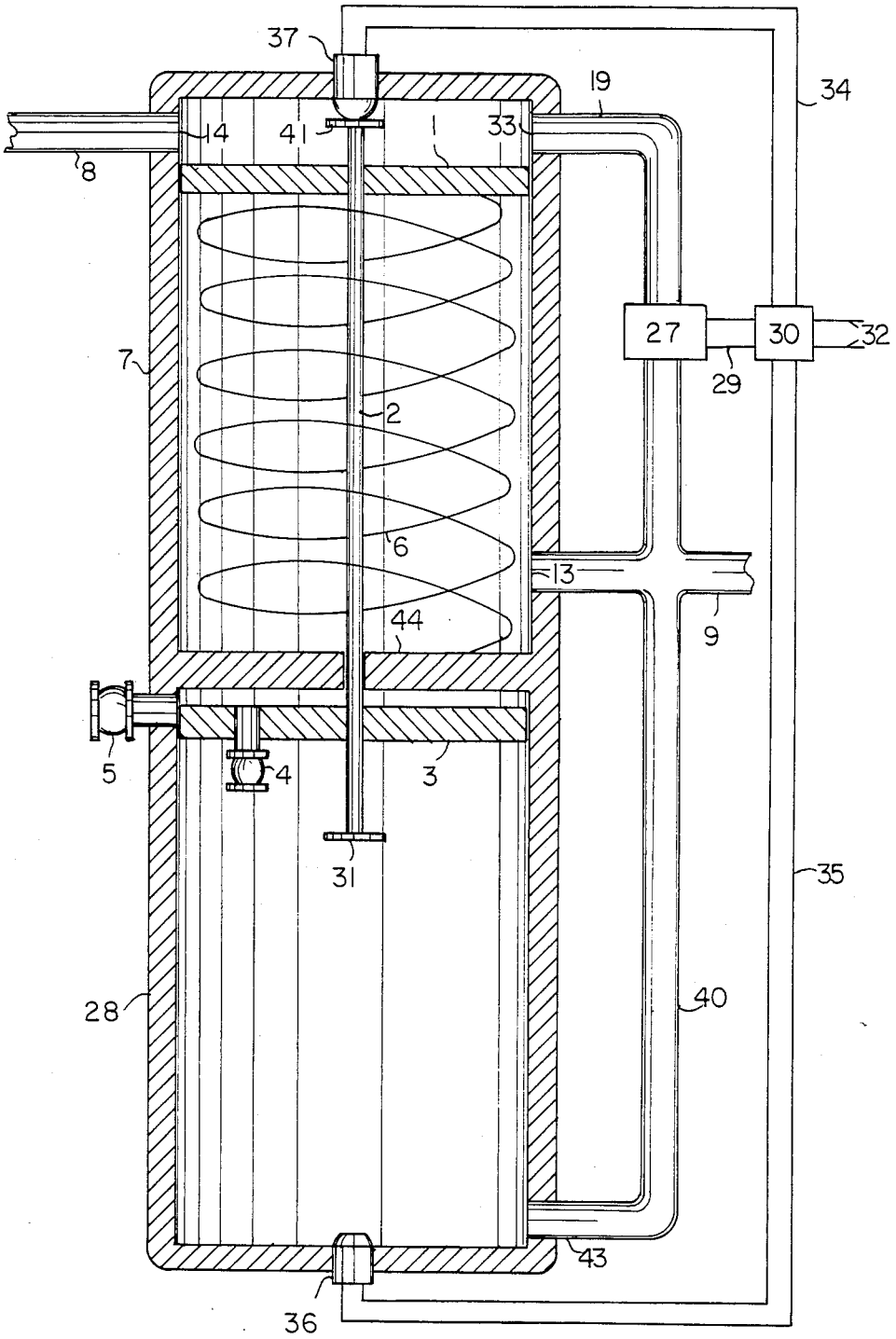

Another embodiment of this invention is illustrated in FIG. 4. This embodiment of this invention functions essentially the same as those shown in FIG. 1, FIG. 2 and FIG. 3. However, the parts are arranged in a different way and the changes in pressure against the driving piston are electrically controlled.

Assuming that the outlet valve to which pipe 9 is connected is open and that solenoid valve 27 is closed, the pressure of the water entering housing section 7 through pipe 8 and opening 14 would cause piston 1 to move toward opening 13 compressing coil spring 6. This would also cause striker plate 31 to move toward waterproof push-button switch 36. Striker plate 31 upon engaging switch 36 would cause it to close circuit 35 thus causing it to activate holding relay switch 30. This would cause solenoid valve 27 to open and allow water to flow through opening 33 and pipe 19 to pipe 9. It also allows water pressure to be applied through opening 13 to the under side of piston 1. This would allow coil spring 6 to push piston 1 back to its starting position.

Upon returning to its starting position, striker plate 42 would engage waterproof push-button switch 37, causing it to open holding circuit 34 through holding relay switch 30, thereby opening the circuit through solenoid valve 27, causing it to close. Then pressure would again be applied to piston 1 starting the cycle over again.

As piston 1 moves toward opening 13, piston 3 would move toward toward push-button switch 36 thus creating a vacuum between dividing wall 44 and piston 3. This would cause air to enter through check valve 5. It would also force any air above piston 3 through opening 43 and pipe 40 to mix with water flowing away from the injector through pipe 9.

As piston 1 moves back toward its starting position, piston 3 would move back toward dividing wall 44 and check valve 4 would open, thus allowing any air compressed between piston 3 and dividing wall 44 to escape into housing section 28. This air would then be forced out on the next cycle to be mixed with the water as stated in the above paragraph.

Circuit 32 would be connected to a power source to provide the electricity necessary to activate solenoid valve 27.

I claim:

1. A device to inject air into water under pressure comprising: An elongated closed housing around two pistons connected to each other by a connecting rod and positioned to slide alternately toward one end of said housing and then toward the other, said pistons being propelled in one direction by the pressure of water entering said housing through an opening from an outside source and propelled in the opposite direction by a coil spring and including a means to alternately increase and decrease water pressure against one piston so that the coil spring is repeatedly being compressed and allowed to expand, causing the second piston to draw in air through a check valve which is mounted in the outer wall of the housing, said air then passing through a second check valve which is mounted in said second piston resulting in a mixing of air and water which air and water leave said housing through one or more openings.

* * * * *